United States Patent [19]

Searle

[11] Patent Number: 5,020,974

[45] Date of Patent: Jun. 4, 1991

[54] FLUID COMPRESSORS

[75] Inventor: Robin H. J. Searle, Somerset, England

[73] Assignee: Normalair-Garrett (Holdings) Limited, Yeovil, England

[21] Appl. No.: 430,660

[22] Filed: Oct. 31, 1989

[30] Foreign Application Priority Data

Nov. 17, 1988 [GB] United Kingdom ..... 8826867

[51] Int. Cl.[5] ..... F04B 25/00

[52] U.S. Cl. ..... 417/246; 91/180; 91/310; 417/347

[58] Field of Search ..... 417/246, 266, 347, 339, 417/403; 91/180, 305, 310; 137/596.15

[56] References Cited

U.S. PATENT DOCUMENTS

| | | | |
|---|---|---|---|
| 2,479,856 | 8/1949 | Mitton | 417/246 X |
| 2,911,005 | 11/1959 | Adelson | 137/596.15 |
| 2,954,155 | 9/1960 | Ray et al. | 417/246 |
| 2,984,257 | 5/1961 | McCormick et al. | 137/596.15 |
| 3,760,843 | 9/1973 | Larner | 137/596.15 |
| 4,714,411 | 12/1987 | Searle | 417/246 |

FOREIGN PATENT DOCUMENTS

| | | | |
|---|---|---|---|
| 2119865 | 11/1983 | United Kingdom | 419/339 |

*Primary Examiner*—Stephen M. Hepperle
*Attorney, Agent, or Firm*—Larson & Taylor

[57] ABSTRACT

A fluid compressor includes a plurality of compression stages each operated sequentially by drive means comprising a pneumatically operated drive piston operating in a drive cylinder. Several embodiments are described and illustrated having different forms of control means and drive and sequencing means for the drive pistons.

20 Claims, 12 Drawing Sheets

FLUID COMPRESSORS

BACKGROUND OF THE INVENTION

1. Field of the invention

This invention relates to fluid compressors and particularly to fluid compressors having a plurality of piston and cylinder compression stages. These compressors have many practical uses in a variety of fields including that of compressing oxygen or oxygen-enriched air to serve as a breathing gas.

2. Description of the Prior Art

A compressor for this purpose is disclosed in GB-A-2177460 and utilises hydraulic fluid under pressure as the source of energy. However a potential problem with this compressor is the incompatibility of the two fluids in that should the hydraulic fluid come into contact with oxygen or highly oxygen-enriched air under pressure there is a risk of explosion. In addition the contamination of the oxygen or oxygen-enriched air by hydraulic fluid can render it unfit for use as a breathing gas and/or interfere with the operation of demand valves and other equipment concerned in regulating the delivery of the gas downstream from the compressor.

Furthermore, this compressor utilises a port plate driven by a positive displacement pressure fluid motor such as a gerotor actuated by the hydraulic fluid, and such an arrangement tends to be bulky and, consequently heavy.

There is therefore a need for a compressor which eliminates the risks associated with the use of incompatible fluids and which is more compact and lighter than the compressor of GB-A-2177460. An objective of the present invention is to provide a compressor meeting these requirements.

SUMMARY OF THE INVENTION

Accordingly, in one aspect, the present invention provides a fluid compressor comprising a plurality of compression stages each having a compression piston operating in a compression cylinder and drive means for driving each compression stage comprising a pneumatically operated drive piston operating in a drive cylinder.

Preferably, each drive piston is controlled by control means comprising at least one inlet valve and at least one exhaust valve arranged for respectively admitting and exhausting compressed air to and from the drive cylinder at least at one side of the drive piston.

Each inlet valve may comprise a diaphragm valve co-operating with an annular valve seat opening into the drive cylinder and located centrally of an annular inlet pressure chamber and each exhaust valve may comprise a diaphragm valve co-operating with an annular valve seat opening into the drive cylinder and located centrally of an annular exhaust chamber.

Spring means may be located in each annular exhaust chamber so as to act on the associated diaphragm valve to bias the diaphragm valve away from its seat.

A control pressure chamber may be located at the side of the diaphragm valves opposite the annular inlet pressure and exhaust chambers, the inlet pressure chambers and the control pressure chambers being connected to a supply of pressurised air and the exhaust chambers being connected via the exhaust valve to ambient. The control means may include valve means for selectively venting the control pressure chambers to operate each of the plurality of drive pistons.

In one embodiment each valve means may comprise a rotatable cam operating two valves arranged to alternately open the ends of fluid passages from the respective control pressure chambers. Drive and sequencing means may be provided for rotating each cam in a predetermined sequence. Said drive and sequencing means may comprise an electric motor having a rotatable shaft attached to one of said cams, each of said cams having an external toothed portion all interconnected by positive drive means.

In a further embodiment, the valve means may comprise for each drive means a tubular rotatable valve having longitudinally spaced-apart and circumferentially staggered ports arranged to communicate with fluid passages from the respective control pressure chambers in a predetermined sequence. Drive and sequencing means may be provided for rotating each valve and in a desired sequence.

Conveniently said drive and sequencing means may comprise an electric motor having a rotatable shaft attached to one of said tubular valves, each of the rotatable valves having a external toothed portion all interconnected by positive drive means.

The positive drive means may comprise an internally toothed timing belt.

In yet a further embodiment the valve means may comprise for each drive means a solenoid controlled valve means arranged to communicate with fluid passages from the respective control pressure chambers in a predetermined sequence.

The valve means may comprise a first valve seat opening into a vent chamber and communicating through an axial bore through a solenoid coil with one or one coupled pair of control pressure chambers, a second valve seat facing and spaced-apart from said first valve seat and opening into said vent chamber and connected to the one or the other coupled pair of control pressure chambers, and a generally cylindrical solenoid armature located in the vent chamber and biased by a spring onto one of said valve seats whereby energisation of the coil overcomes the spring to move the armature to close the other valve seat.

The plurality of solenoids may be operated at a predetermined frequency to operate the drive means and may be phase controlled to ensure appropriate sequential operation of the plurality of compression stages.

The plurality of compression cylinders may be of progressively reducing diameter between a largest diameter low pressure stage and a smallest diameter high pressure stage. A fluid inlet connection may be provided for introducing fluid to be compressed into said low pressure compression stage, flow passages may be provided for conducting fluid sequentially through said stages and a fluid outlet connection may be provided for conveying pressurised fluid from the high pressure stage.

Preferably three compression stages are provided.

BRIEF DESCRIPTION OF THE DRAWINGS

The invention will now be described by way of example only and with reference to the accompanying drawings in which.

DETAILED DESCRIPTION OF THE DRAWINGS

Figure 14:
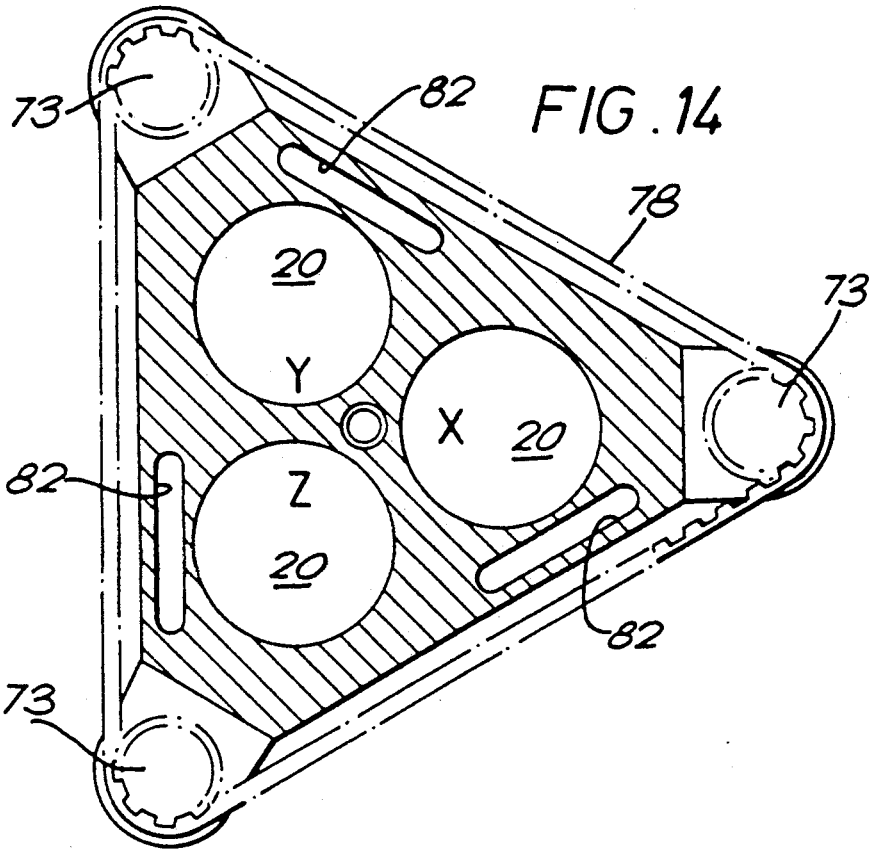
FIG. 14 is a sectioned view taken on lines H—H of FIG. 13.
Figure 15:
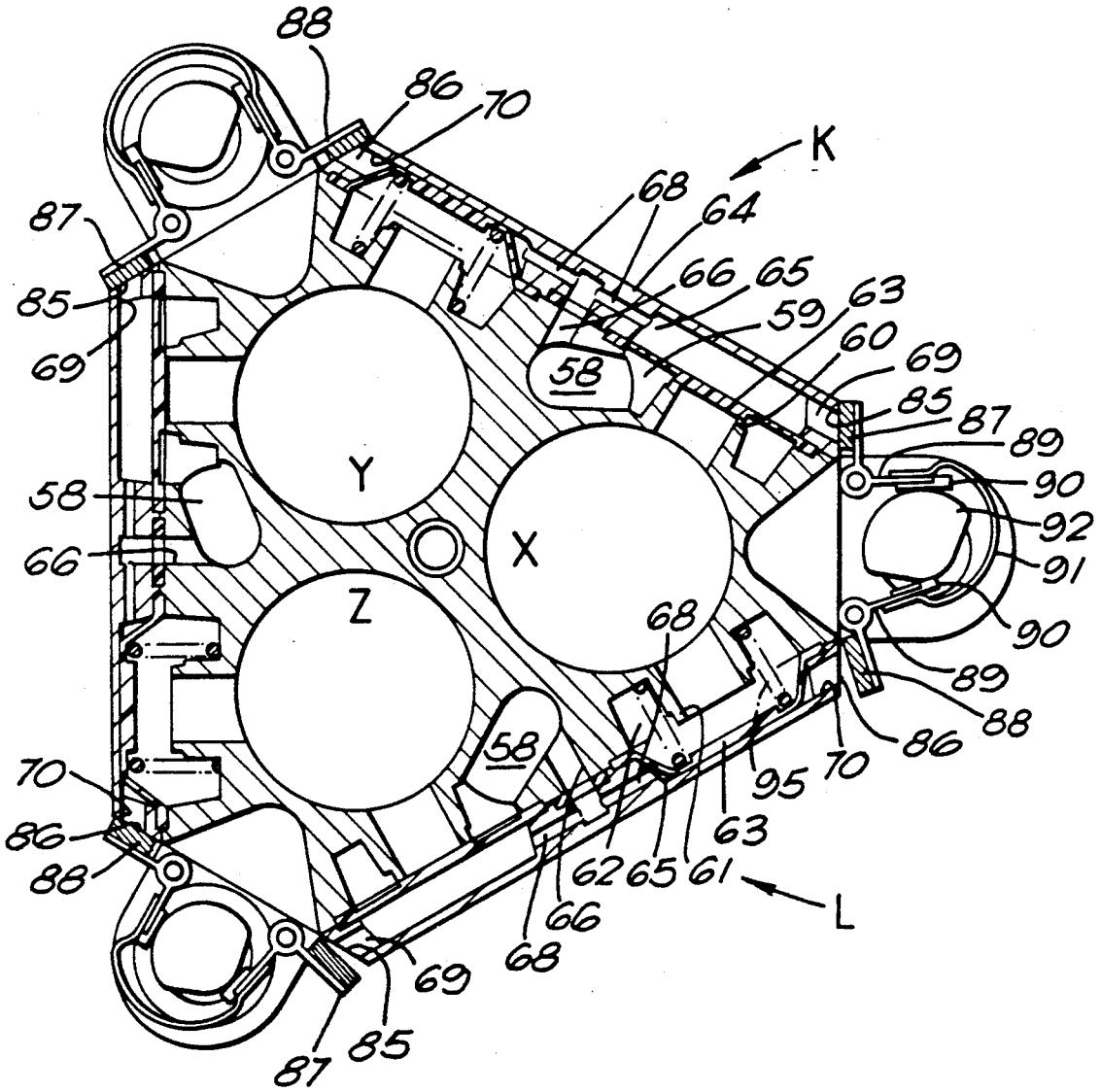
FIG. 15 is a sectioned view taken on lines J—J of FIG. 13.

In the following text a reference to the first illustrated embodiment of the invention means the embodiment of FIGS. 1 to 4 inclusive, a reference to the second illustrated embodiment means the embodiment of FIGS. 5 to 11 inclusive and a reference to the third illustrated embodiment means the embodiment of FIGS. 13 to 15 inclusive. Until noted otherwise in the text, the following description applies to all illustrated embodiments, and like reference numerals are used to indicate similar parts.

An oxygen compressor 11 includes a main body portion 12, a cylinder block 13 and a gas distributor block 14 secured via a three armed clamp plate 15 by an axial bolt 16.

Figure 1:
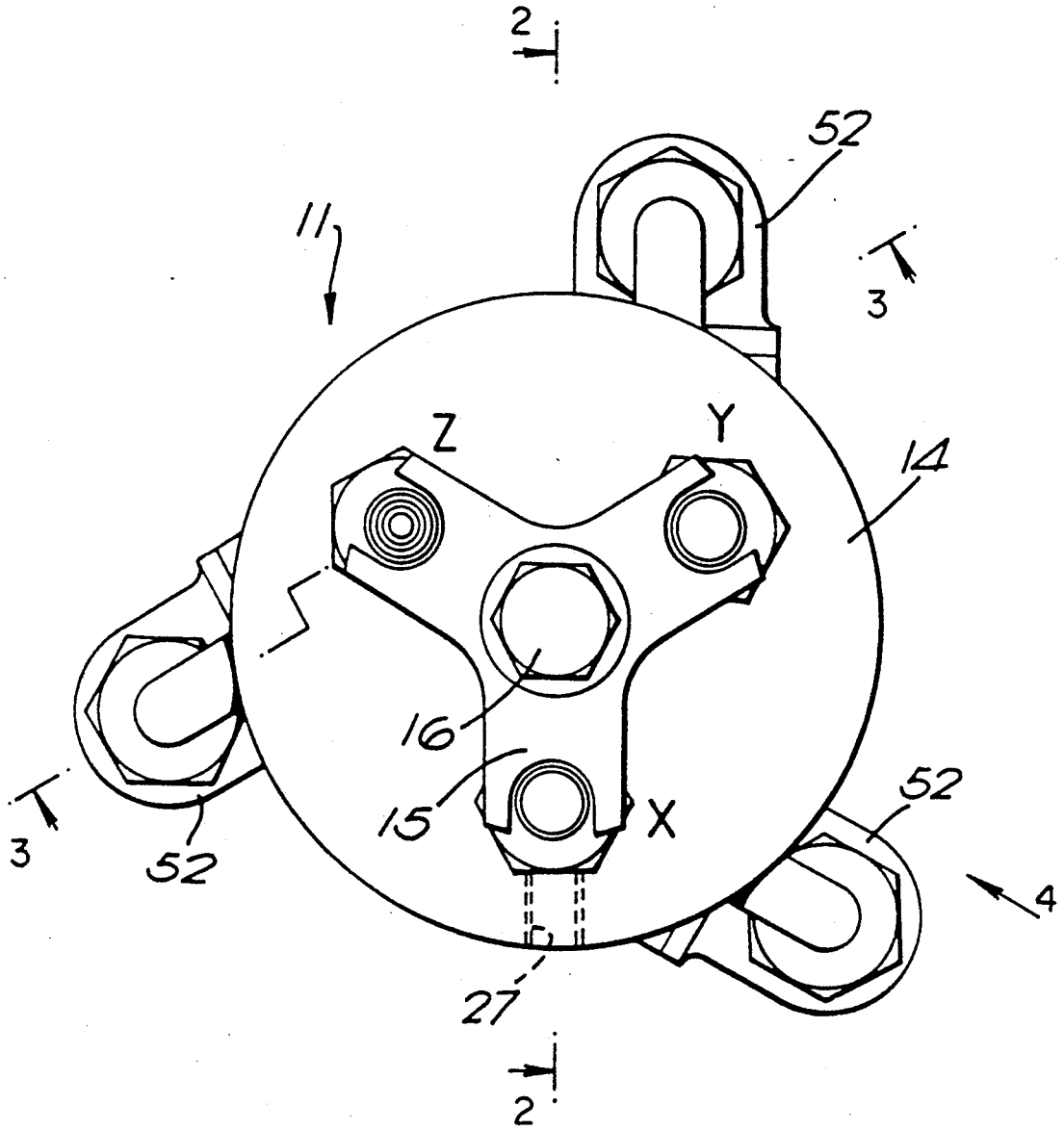
FIG. 1 is a plan view of a compressor constructed according to one embodiment of the invention.
Figure 2:
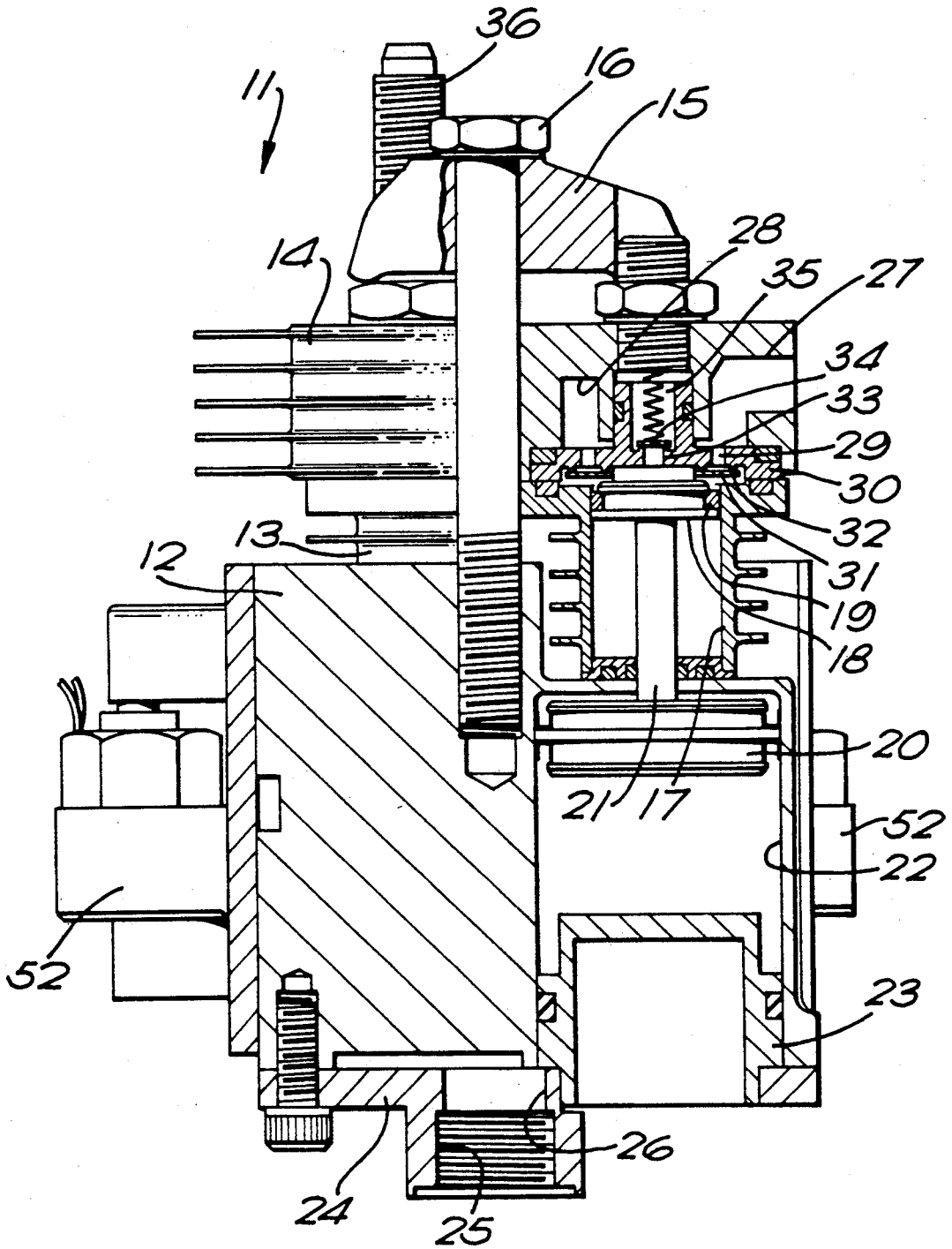
FIG. 2 is a fragmentary sectioned view taken on lines A—A of FIG. 1.
Figure 6:
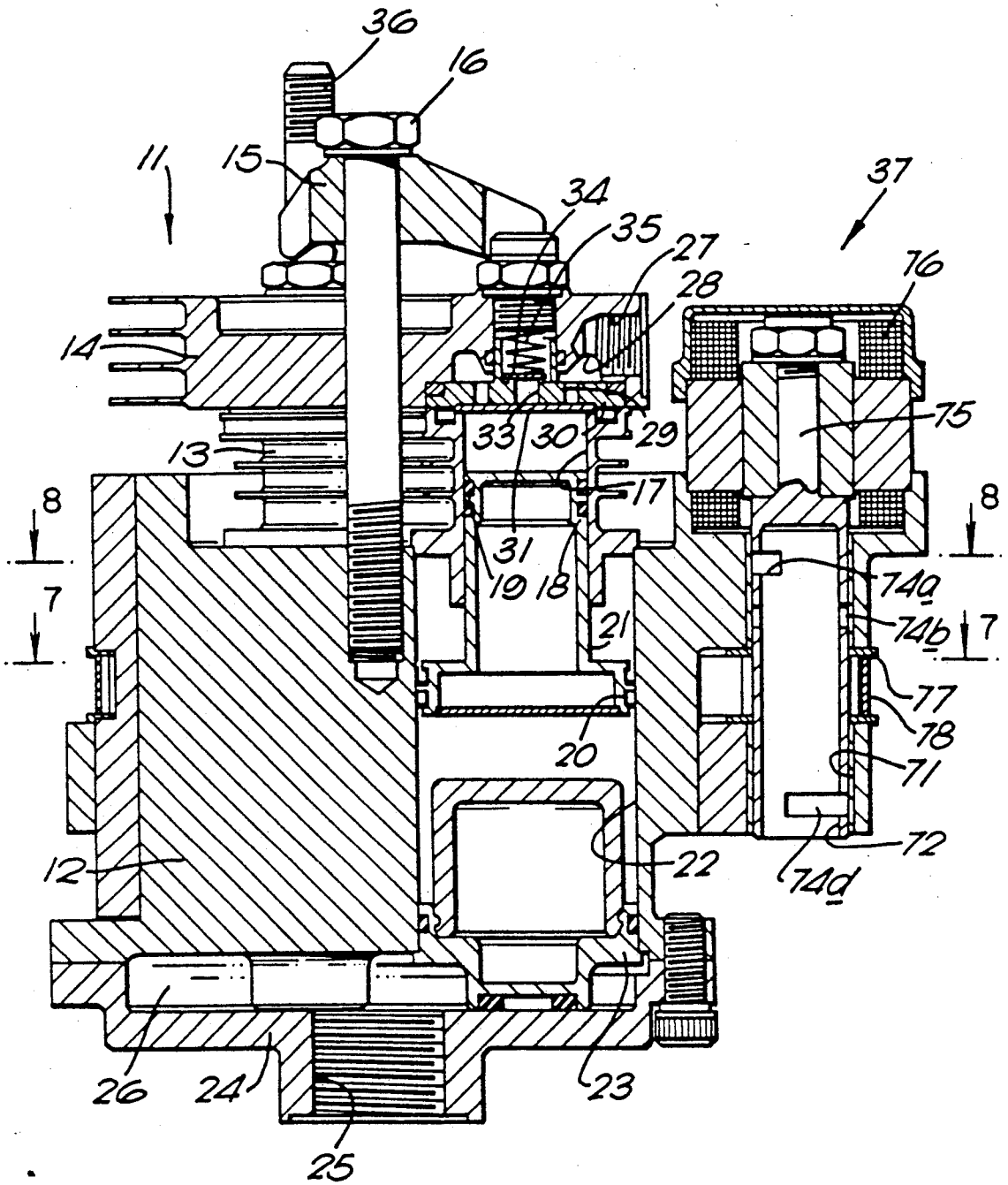
FIG. 6 is a sectioned view taken on lines D—D of FIG. 5.
Figure 7:
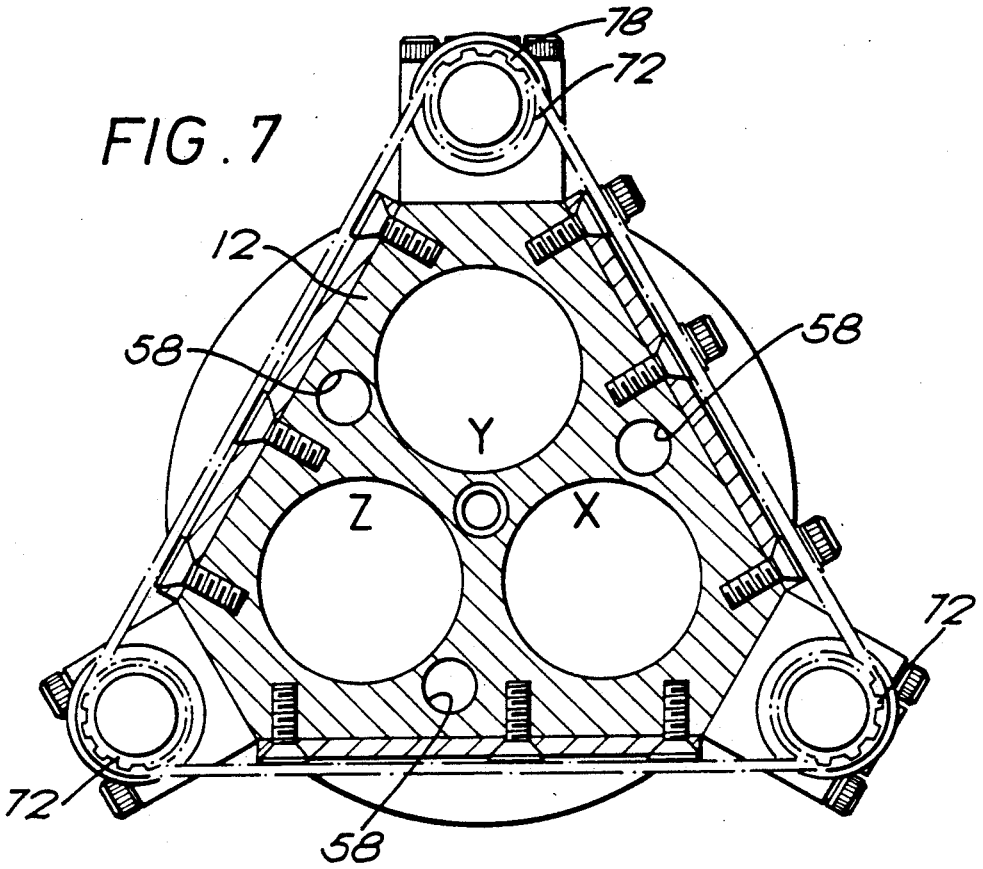
FIG. 7 is a sectioned view taken on lines E—E of FIG. 6.
Figure 9:
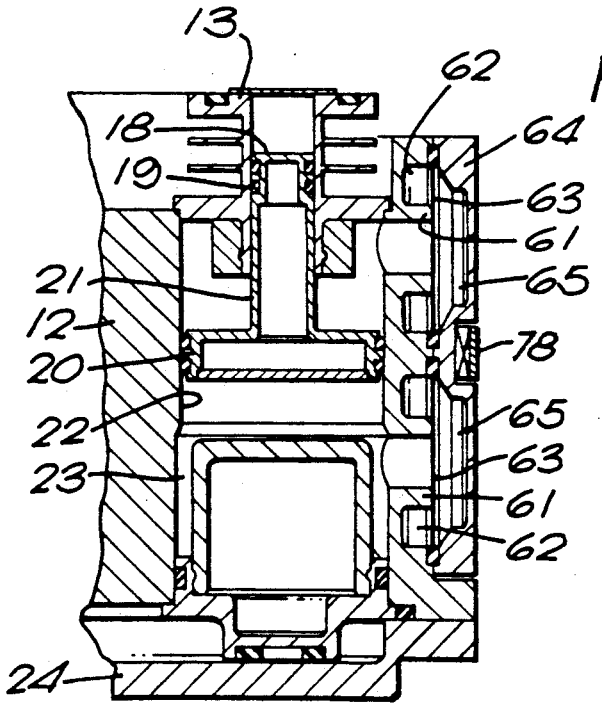
FIG. 9 is a fragmentary sectioned view taken on lines G—G of FIG. 8.
Figure 13:
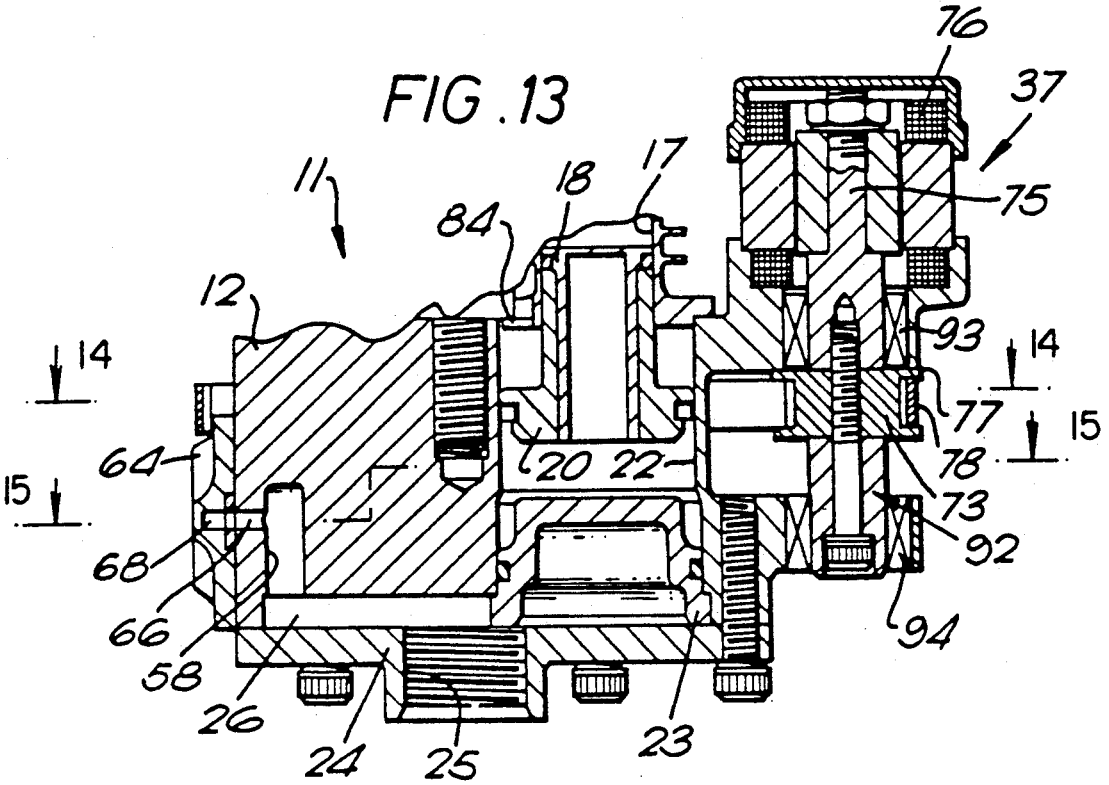
FIG. 13 is a fragmentary sectioned view of a compressor constructed according to a further embodiment of the invention.

The compressor 11 comprises three compression stages indicated spatially for reference only at (X), (Y) and (Z) in FIG. 1, 7 and 13 respectively. The compression stages each comprise a compression cylinder 17 formed in cylinder block 13, compression cylinder 17 of the first compression stage (X) being shown in FIGS. 2, 6 and 13 compression cylinder 17 of the third compression stage (Z) being shown in FIG. 3 and compression cylinder 17 of the second compression stage Y being shown in FIG. 9. The three compression cylinders 17 are arranged in a circle about an axis with their axes parallel with one another and are of progressively reducing diameter with compression stage X having the largest diameter compression cylinder 17 and compression stage Z the smallest.

Compression pistons 18 are located in each cylinder 17 for reciprocating movement and are each fitted with a sealing ring 19.

Each of the compression stage piston and cylinder assemblies is associated with drive means comprising individual driving piston and cylinder assemblies aligned therewith and comprising a drive piston 20 at the end of a piston rod 21 and located in a drive cylinder 22 formed in body portion 12.

The outer ends of the drive cylinders 22 are sealed with a cap 23 retained by a drive gas inlet cap 24 having a drive gas inlet connection 25 connecting with an internal chamber 26.

Gas distributor block 14 includes a connector 27 adapted during operation for connection to a source of pressurised oxygen or oxygenenriched air and communicates with an inlet annular chamber 28 located above the compression cylinder 17 of first compression stage (X). Annulus 28 communicates with a concentric ring of holes 29 in a plate member 30 and a flat annular non-return valve plate 31 is retained in contact with two annular valve seats 32 straddling the holes 29 by a spring (not shown). In the embodiment of FIGS. 5 to 10 inclusive annular valve seats 32 are omitted (FIG. 6).

A central hole 33 through plate member 30 communicates via a spring-loaded non-return valve plate 34 with an outlet chamber 35.

Whilst the above described oxygen inlet and outlet valving arrangement is similar for all three compression stages of all embodiments it should be noted that the largest diameter cylinder 17 associated with the first compression stage (X) is the only cylinder communicating directly with an external oxygen supply connected at 27. The outlet chamber 35 is connected through an internal drilling 80 (shown in FIGS. 11 and 12 only) in block 14 to an annular inlet chamber 28 (FIGS. 11 and 12) associated with the second compression stage (Y) and the outlet chamber of the second compression stage cylinder is connected through an internal drilling 81 (shown in FIGS. 11 and 12 only) to annular inlet chamber 28 associated with the third compression stage (Z) and illustrated in FIG. 3. The outlet chamber 35 of the third compression stage (Z) connects through a drilled connector 36 for connection during operation to an oxygen storage container (not shown).

Figure 3:
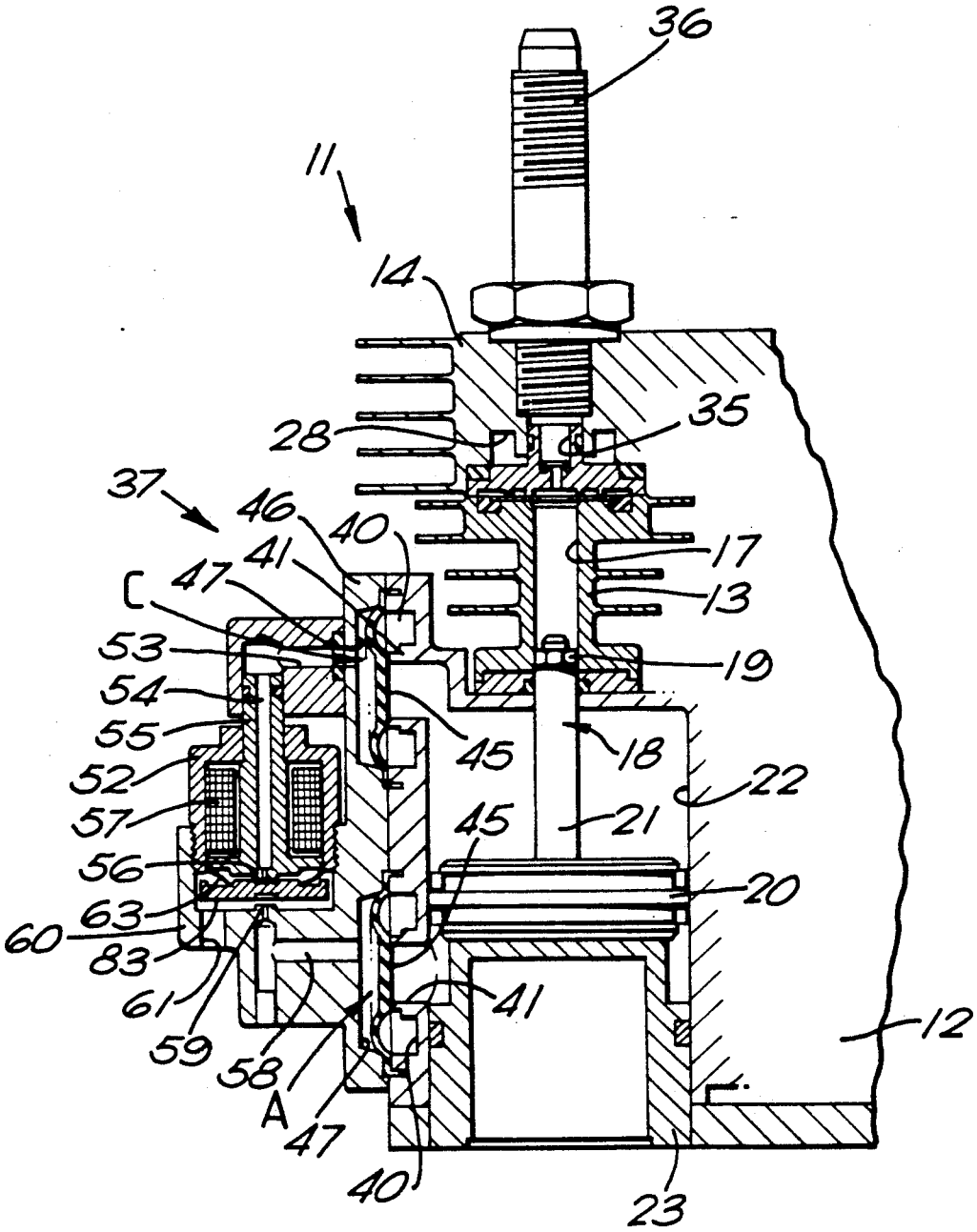
FIG. 3 is a fragmentary sectioned view taken on lines B-B of FIG. 1.

In all of the embodiments of this invention the drive pistons 20 are driven by pressurised air that in operation is conveniently derived from engine bleed air, and each of the drive pistons 20 is controlled by control means generally indicated at 37 (FIGS. 3, 6 and 13).

Figure 4:
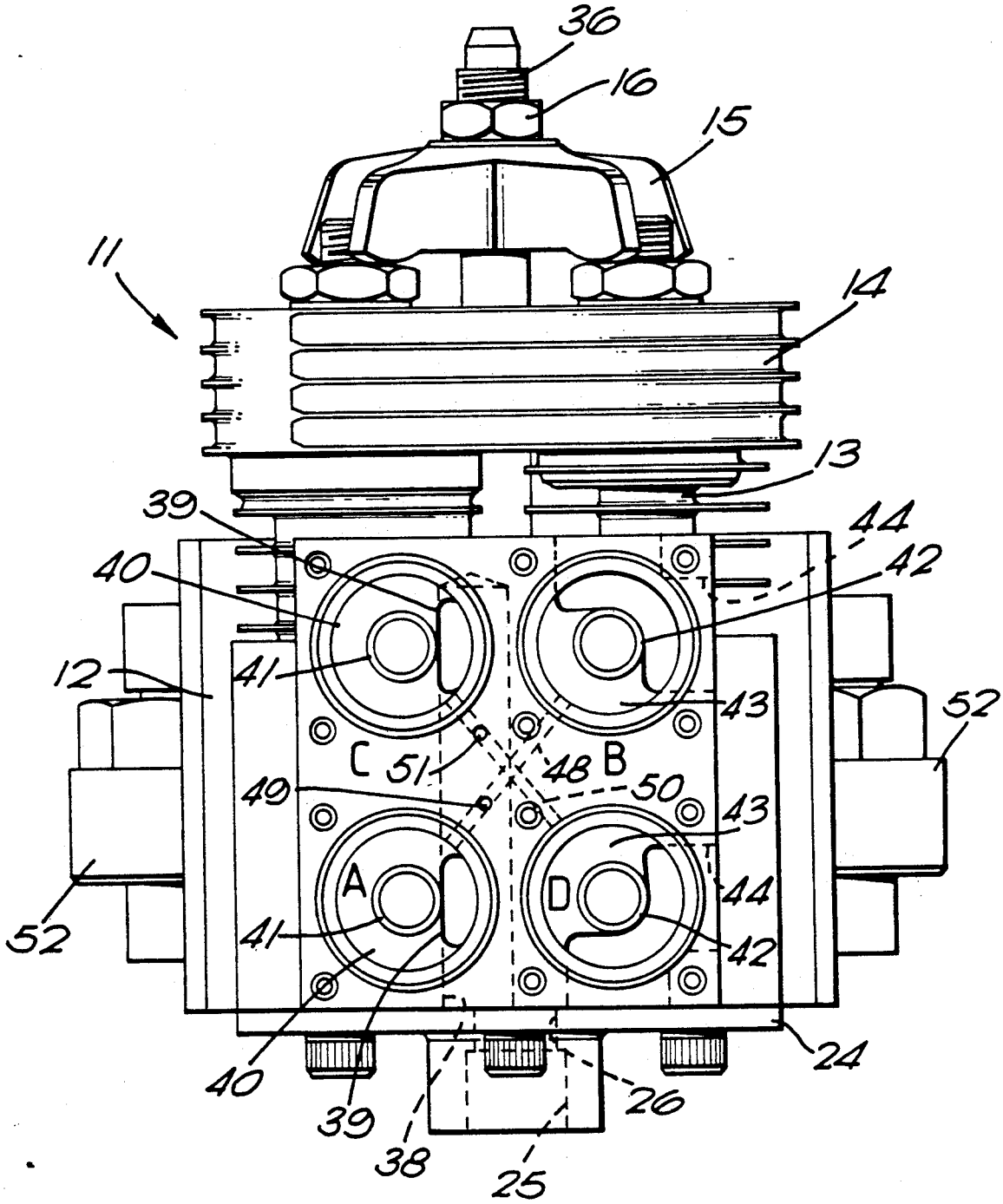
FIG. 4 is a view on arrow C of FIG. 1 with certain parts removed for explanatory purposes.
Figure 5:
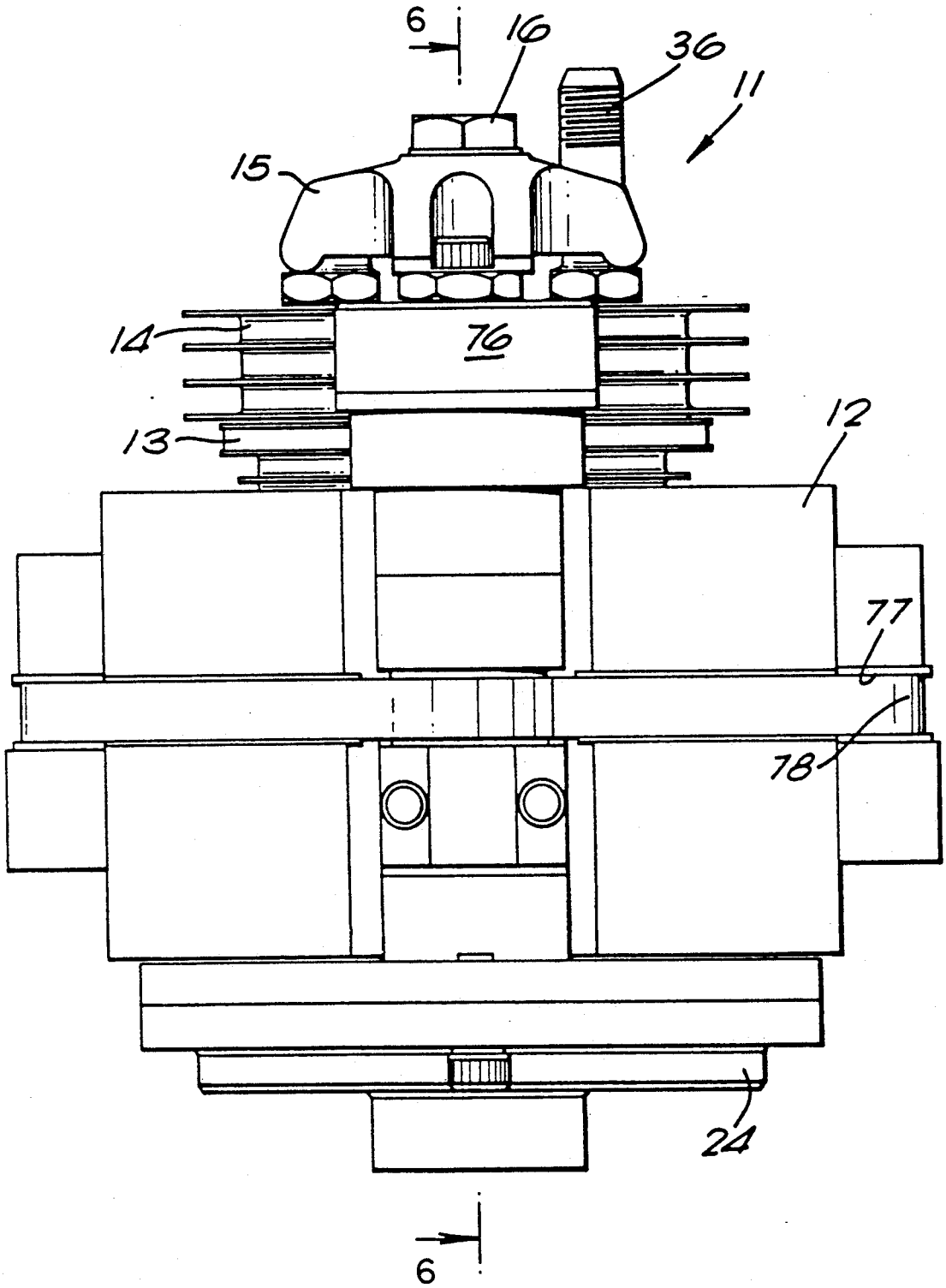
FIG. 5 is an end view of a compressor constructed according to a further embodiment of the invention.

Referring now to the first illustrated embodiment and particularly to FIGS. 3 and 4, chamber 26 communicates with an axially extending drive gas inlet bore 38 which communicates through two oval apertures 39 with vertically spaced-apart annular inlet pressure chambers 40 surrounding central annular valve seats 41 communicating with the interior of drive cylinder 22 at both sides of drive piston 20. Two further annular valve seats 42 communicate similarly with the interior of drive cylinder 22 and are surrounded by annular exhaust chambers 43 which communicate with ambient through ports 44 in body portion 12.

A diaphragm valve 45 is associated with each of the four valve seats 41 (2 off) and 42 (2 off), the valves being retained by a cover 46 which includes four control pressure chambers 47 (two only being shown in FIG. 3) at the side of diaphragm valves 45 opposite the annular inlet and exhaust chambers 40 and 43.

Reverting for a moment to FIG. 4, valve seats 41 and 42 are identified respectively as A, B, C and D, valves A and C being inlet valves (also shown in FIG. 3) and valves B and D being exhaust valves. Drilled passages 48 interconnect the control pressure chambers 47 of inlet valve A and exhaust valve B and connect also through orifice 49 to inlet bore 38. Similarly, drilled passage 50, and orifice 51 interconnects the control pressure chambers 47 of inlet valve C and outlet valve D and connects the interconnected chambers to inlet bore 38. Whilst shown schematically and for convenience of description in FIG. 4, it is to be understood that the passages 48 and 50 interconnecting respectively valves A and B and valves C and D are located in cover 46 which is not shown in FIG. 4.

The control means 37 further includes an electrically operated solenoid 52 for controlling the pressure in the respective control pressure chambers 47. Thus, as shown in FIG. 3, control pressure chamber 47 associated with inlet valve C communicates through drilling 53 in cover 46 and through a bore 54 through solenoid valve core 55 which terminates at a first valve seat 56.

Core 55 is surrounded by coil 57.

Chamber 47 associated with inlet valve A communicates through passage 58 terminating at a second valve seat 59 spaced-apart from first valve seat 56. Valve seats 56 and 59 open into a chamber 60 which is vented to ambient through passage 61 and houses a cylindrical armature 83 of solenoid valve 52. Spring means 63 biases armature 83 towards second valve seat 59.

Armature 83 includes, in opposed surfaces, sealing means for sealing selectively each of the valve seats 56 and 59.

It will be understood that the above described arrangement of inlet and exhaust valves and solenoid valve 52 is provided for each of the three compression stages (X), (Y) and (Z).

Figure 8:
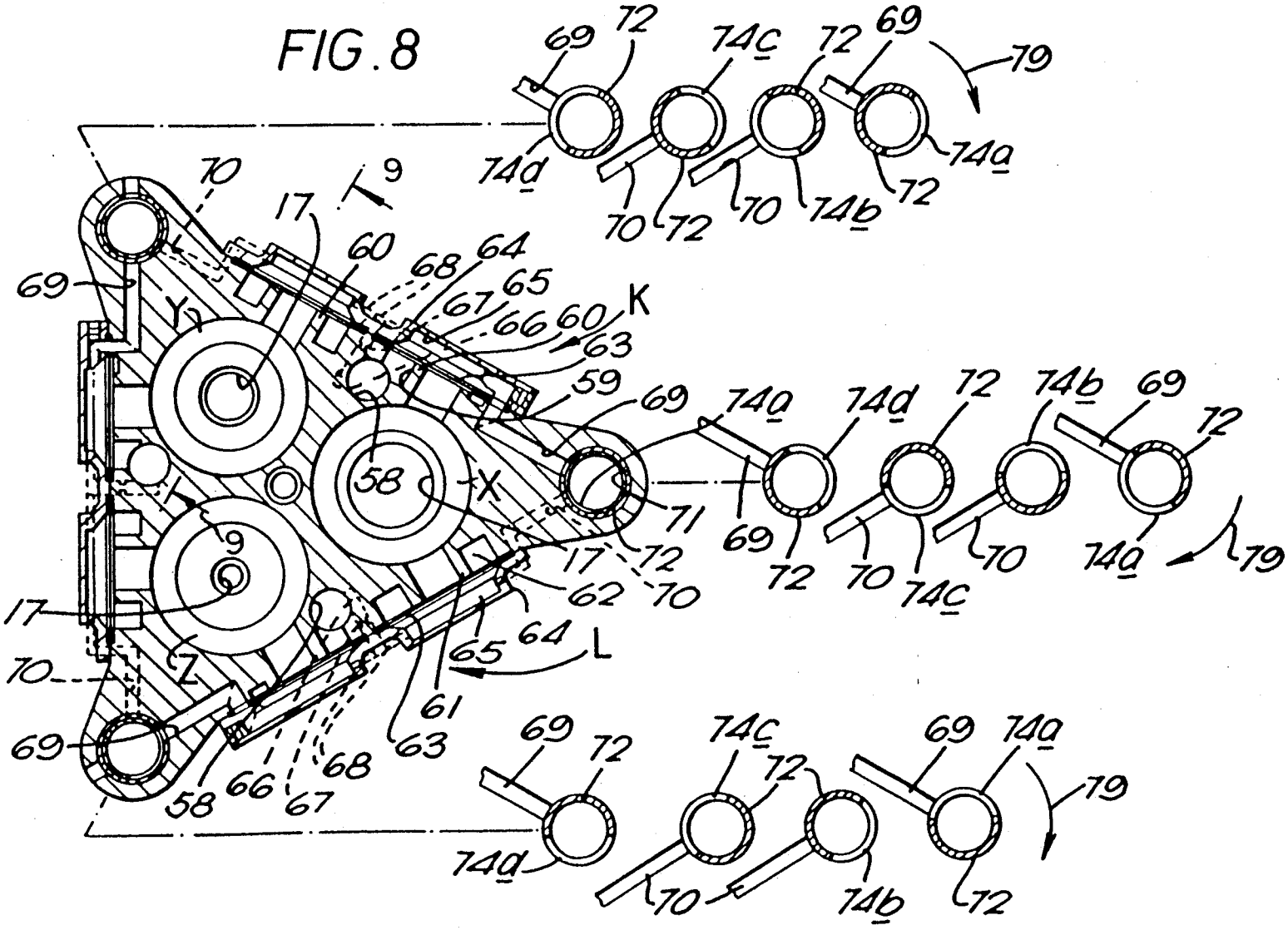
FIG. 8 is a sectioned view taken on lines F—F of FIG. 6 and including diagrammatic representations for explanatory purposes.

Referring now to the second illustrated embodiment and in particular to FIGS. 6, 7 and 8, chamber 26 communicates with three axially extending drive gas inlet bores 58 which each communicate with vertically spaced-apart annular inlet pressure chambers 59 surrounding central annular valve seats 60 communicating with the interior of drive cylinders 22 at both sides of the respective drive pistons 20. Two further vertically spaced-apart annular valve seats 61 communicate similarly with the interior of each drive cylinder and are surrounded by annular exhaust chambers 62 which communicate with ambient through ports 82 (shown in FIG. 11 only) in body portion 12.

A diaphragm valve 63 is associated with each of the four valve seats 60 (2 off) and 61 (2 off) associated with each compression stage, the valves being retained by a cover 64 which includes four control pressure chambers 65 at the side of the diaphragm valves 63 opposite the annular inlet and exhaust chambers 59 and 62 respectively.

Figure 11:
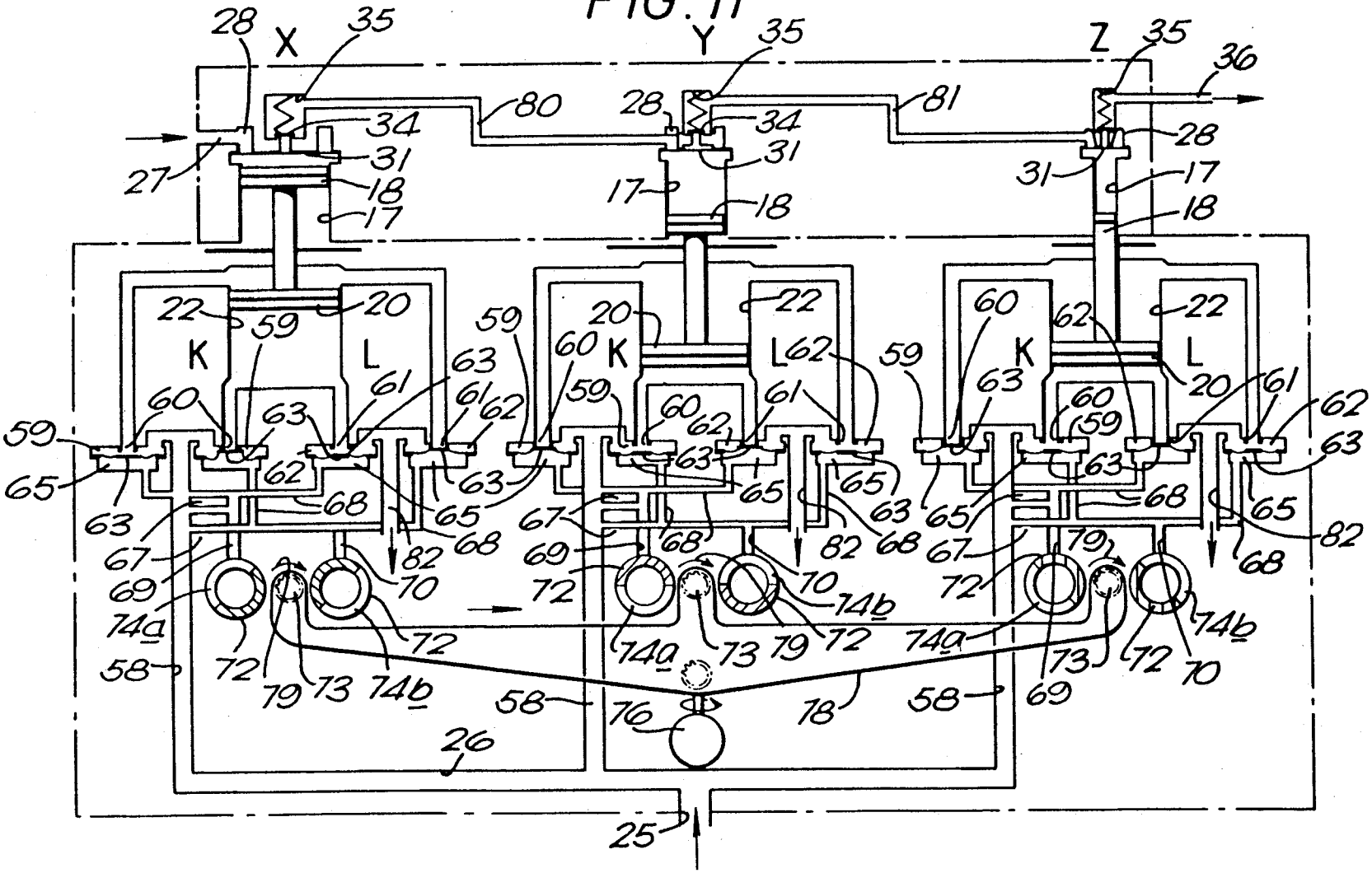
FIG. 11 is a schematic arrangement of the compressor illustrated in FIGS. 5 to 10 inclusive.

Each of the drive gas inlet bores 58 communicates individually with its adjacent four control pressure chambers 65 through a drilled passage 66, and two smaller diameter branch passages 68 shown diagrammatically in FIGS. 8 and 11. Each of the control pressure chambers 65 is connected through drilled passages 69 and 70 to the interior of vertical bores 71 located at the apices of the triangular shaped body portion 12. Bores 71 are shown diagrammatically in FIG. 11.

In this second embodiment, respective compression stages X, Y and Z are controlled by a pair of inlet valves and a pair of exhaust valves similar to the first embodiment except that the respective pairs of valves are located at either side of the apices of the body portion 12. Thus, taking compression stage X (stage 1) as an example, it is controlled by the pair of vertically spaced-apart inlet valves K and by the pair of vertically spaced-apart exhaust valves L (FIG. 8).

It will be understood therefore that two drilled passages 69 associated with inlet valves K and two drilled passages 70 associated with exhaust valves L communicate with each of the vertical bores 71, the passages 69 and 70 being spaced-apart vertically in body portion 12. Thus, in the illustrated embodiment passage 69 associated with the uppermost of the inlet valves K for admitting air to drive cylinder 22 above the drive piston 20 is located uppermost followed by the first of the passages 70 associated with the uppermost of the exhaust valves L for exhausting air from drive cylinder 22 above the drive piston 20. Next comes the second of the passages 70 associated with the lowermost of the exhaust valves L for exhausting air from drive cylinder 22 below the drive piston. In the lowermost position is the second of the passages 69 associated with the lowermost of the inlet valves K for admitting air to drive cylinder 22 below the drive piston 20.

In this embodiment control means 37 includes integral power and sequencing means comprising a tubular valve 72 rotatably mounted in each vertical bore 71 for controlling air pressure in the respective control pressure chambers 65.

Figure 10:
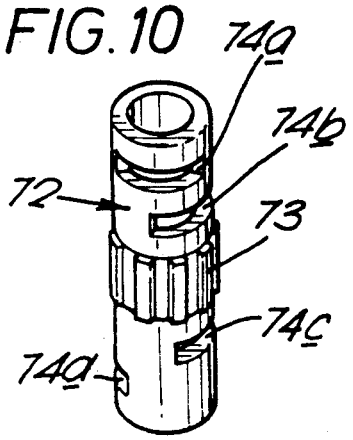
FIG. 10 is a perspective illustration of a part of the embodiment of FIGS. 5 to 9 inclusive.

As shown in FIG. 10, each of the tubular valves 72 includes an intermediate toothed portion 73 and four longitudinally spaced-apart circumferentially staggered ports 74*a*, 74*b*, 74*c*, and 74*d* which, upon rotation, are arranged to communicate with the two passages 69 and two passages 70 associated with each of the pairs of inlet and outlet valves K and L and in a predetermined sequence.

One of the tubular valves 72 is attached to the rotatable shaft 75 of an electric motor 76 attached to the housing 12 (FIG. 6), and the toothed intermediate portion 73 of all three of the valves 72 are located in appropriate slots 77 in the housing 12 and are all interconnected by positive drive means comprising a toothed neoprene/rayon timing belt 78.

Thus, the arrangement of the ports 74*a*, 74*b*, 74*c*, and 74*d* in the individual valves 72 provides an appropriate sequence to operate the individual compression stages X, Y and Z in the alternate compression and return strokes, and the toothed timing belt 78 operated by electric motor 76 ensures that a predetermined sequential operation of the three compression stages is maintained during operation as hereafter explained. FIG. 8 includes diagrammatic representations of each of the valves 72 and the relative position of their ports 74*a*, 74*b*, 74*c*, and 74*d* and the respective passages 69 and 70 for each of the compression stages X, Y and Z at one instantaneous position during their rotation. The direction of rotation of the valves 72 is shown by the arrows 79. FIG. 11 shows, for each compression stage, the relative position of ports 74*a* and 74*b* only and the respective passages 69 and 70.

In both of the previously described embodiments the drive pistons 20 of each compression stage are double-acting pistons driven through both of their compression and return strokes in drive cylinders 22. This arrangement dictates that each drive piston 20 be controlled by two inlet valves and two exhaust valves for respectively admitting and exhausting compressed air to and from the drive cylinder 22 at both sides of the drive piston 20. However, experiments have shown that in installations in which the fluid to be compressed is delivered to the compressor at a positive pressure, e.g. in the aforementioned use in supplying a breathing gas the oxygen is typically delivered at about 35 psi, the return stroke of the piston 20 even in the low pressure stage can be accomplished by the pressure of the oxygen entering the compression cylinders 17.

Such an arrangement, hereafter referred to as a single-acting piston arrangement, therefore requires for each drive piston 20 only one inlet valve, e.g. inlet valve A in FIG. 4, and one exhaust valve, e.g. exhaust valve D in FIG. 4, both communicating with drive cylinder 22 below drive piston 20.

This invention therefore extends to compressors substantially as hereinbefore described in respect of the first and second illustrated embodiments and incorporating a single-acting piston arrangement which greatly simplifies the design and results in a lighter and more compact construction.

Furthermore, such a single-acting piston arrangement will now be described in combination with a further embodiment of the invention and with reference to FIGS. 13 to 15 inclusive. This embodiment is a development of the embodiment of FIGS. 5 to 11 and like reference numerals are again used to indicate similar parts. Reference should be made to the earlier text for a description of the common parts.

Referring now to FIG. 13, each drive cylinder 22 is vented to ambient through aperture 84 in the body portion 12 above the drive piston 20 in order to facilitate the use in this embodiment of the single-acting drive piston arrangement.

Chamber 26 communicates with three axially extending drive gas inlet bores 58 which each communicate with a single annular inlet pressure chamber 59 surrounding a central annular valve seat 60 communicating with the interior of the respective drive cylinders 22 below the drive piston 20. A further valve seat 61 communicates similarly with the interior of each drive cylinder 22 and is surrounded by an annular exhaust chamber 62 which is vented to ambient through ports 82 (FIG. 14) in body portion 12.

A diaphragm valve 63 is associated with each of the two valve seats 60 and 61 associated with each compression stage and are again retained by a cover 64 which includes two control pressure chambers 65 at the side of the diaphragm valves 63 opposite the annular inlet and exhaust chambers 59 and 62 respectively.

Each of the drive gas inlet bores 58 communicates individually with its adjacent two control pressure chambers through drilled passages 66, orifices 67 and passages 68. Each of the control pressure chambers 65 is connected through drilled passages 69 and 70 terminating at open ends 85 and 86 respectively located at either side of the apices of the body portion 12.

A spring 95 is located in the annular exhaust chamber 62 associated with each compression stage and acts on the diaphragm valve 63 to bias the diaphragm valve 63 away from its valve seat 61.

Respective compression stages are controlled by a single inlet valve and a single exhaust valve located at either side of the apices of the body portion 12 and, taking compression stage X (stage 1) as an example it is controlled by the inlet valve identified 'K' and the exhaust valve identified 'L'.

In this third illustrated embodiment control means 37 comprises integral power and sequencing means comprising pad valves 87 and 88 associated with the open ends 85 and 86 of respective passages 69 and 70 for controlling air pressure in the control pressure chambers 65. The valves 87 and 88 are located on one arm of right angled levers 89 pivotally mounted to the body portion 12, the other arm of levers 89 carrying friction pads 90 retained by a spring 91 in contact with an external surface of a rotatable cam 92. Each cam 92 is rotatably fixed to a toothed central portion 73 between spindle portions located in upper and lower bearings 93 and 94 (FIG. 13), the spindle portion of the cam 92 associated with the first compression stage being formed integral with the rotatable shaft 75 of an electric motor 76 attached to body portion 12. The toothed central portions 73 of all three cams 92 are interconnected by positive drive means comprising a toothed neoprene/rayon timing belt 78.

In operation of the compressor 11 of the first illustrated embodiment of this invention, the three solenoid valves 52 are operated at a predetermined frequency which, in one application is 25 Hz, and are phase-controlled to ensure appropriate sequential operation by control unit (not shown) which forms no part of the invention.

Pressurised engine bleed air enters connection 25, inlet bores 38 and respective apertures 39 to enter annular inlet pressure chambers 40 associated with each pair of inlet valves A and C. Pressurised gas also flows from inlet bore 38 through orifice 49 and passage 48 to the control pressure chambers 47 at the other side of diaphragm valves 45 of diagonally opposed inlet valve A and exhaust valve B and similarly through orifice 51 and passage 50 to the control pressure chambers 47 of diagonally opposed inlet valve C and exhaust valve D.

Referring for convenience to FIG. 3 wherein the drive piston 20 of the third stage compression chamber is at the end of its return stroke, energisation of the coil 57 of solenoid 52 attracts armature 83 to seal valve seat 56 and prevent escape of pressurised air from control pressure chamber 47 of inlet valve C so as to retain diaphragm valve 45 in contact with its seat 41. At the same time control pressure chamber 47 associated with inlet valve A vents through open valve seat 59, chamber 60 and vent 61 so that pressurised air in annular inlet pressure chamber 40 of inlet valve A moves the diaphragm valve 45 off its valve seat 41 to enter drive cylinder 22 beneath drive piston 20 to move the piston 20 up the cylinder. The exhaust of gas from above piston 20 occurs through exhaust valve B because of the interconnection between its control pressure chamber 47 and the control pressure chamber 47 of inlet valve A.

De-energisation of the coil 57 prevents the escape of pressurised air from the control pressure chambers 47 of inlet valve A and exhaust valve B by closing valve seat 59. This automatically opens valve seat 56 to bleed control pressure chambers 47 of inlet valve C and exhaust valve D to move the drive piston 20 through its return stroke back to the position illustrated in FIG. 3.

In operation of the compressor 11 of the second illustrated embodiment of this invention, the electric motor 76 is rotated at a predetermined speed which, in one application, is 1500 rpm.

Pressurised engine bleed air enters connection 25 and inlet bores 58 to enter annular inlet pressure chambers 59 associated with each of the three pairs of inlet valves K. Pressurised air also flows through passages 66, orifices 67 and passages 68 to the control pressure chambers 65 at the other side of diaphragm valves 63 on all of the inlet valves K and exhaust valves L.

Operation will be described with reference to the first compression stage X and with particular reference to FIGS. 8 and 11. Drive piston 20 is to be assumed at the end of its compression stroke.

Port 74*a* of valve 72 is shown in communication with its associated passageway 69 so that control pressure chamber 65 of upper inlet valve K vents to ambient through the hollow bore of tubular valve 72 faster than it can be replenished through orifice 67. Pressurised gas in annular inlet pressure chamber 59 of the top inlet valve K moves the diaphragm valve 63 off its valve seat 60 to enter drive cylinder 22 above the drive piston 20. Passageway 70 from the top exhaust valve L is blocked by valve 72 so that pressure in control pressure chamber 65 retains the valve 63 in contact with its seat 61 to prevent exhaust of pressurised air from drive cylinder 22 above the drive piston 20. Port 74*c* communicates with passageway 70 of the lower exhaust valve L to bleed the respective control pressure chamber 65 and allow pressure in the drive cylinder 22 below the drive piston 20 to move diaphragm valve 63 off its seat 61 and vent to ambient from annular exhaust chamber 62. At the same time passageway 69 of lower inlet valve K is blocked by valve 72 so that respective diaphragm valve 63 is retained on its seat 60 to prevent pressurised air entering the drive cylinder 22 below the drive piston 20.

The net result of the described arrangement is that the drive piston 20 of first compression stage X is moved downwardly through the drive cylinder 22 to complete its return stroke. It is not considered necessary to describe in detail the subsequent compression stroke which is achieved by a reverse of the porting arrangement described and will be readily apparent to anyone skilled in the art.

In operation of the unillustrated embodiment comprising the combination of the embodiment of FIGS. 1 to 4 inclusive with a single-acting drive piston arrangement, inlet valve C and exhaust valve B (FIG. 4) communicating with drive cylinder 22 above drive piston 20 are not included and the control pressure chamber 47 associated with exhaust valve D is connected through a drilled passage directly with the drilling 53. Consequently, inlet valve A and exhaust valve D are controlled by the solenoid 52 to open alternately to admit and exhaust compressed air to and from the drive cylinder 22 beneath drive piston 20, and the return stroke of drive piston 20 is achieved by the pressure of the oxygen to be compressed entering the respective compression chambers 17 and acting on compression pistons 18.

Figure 12:
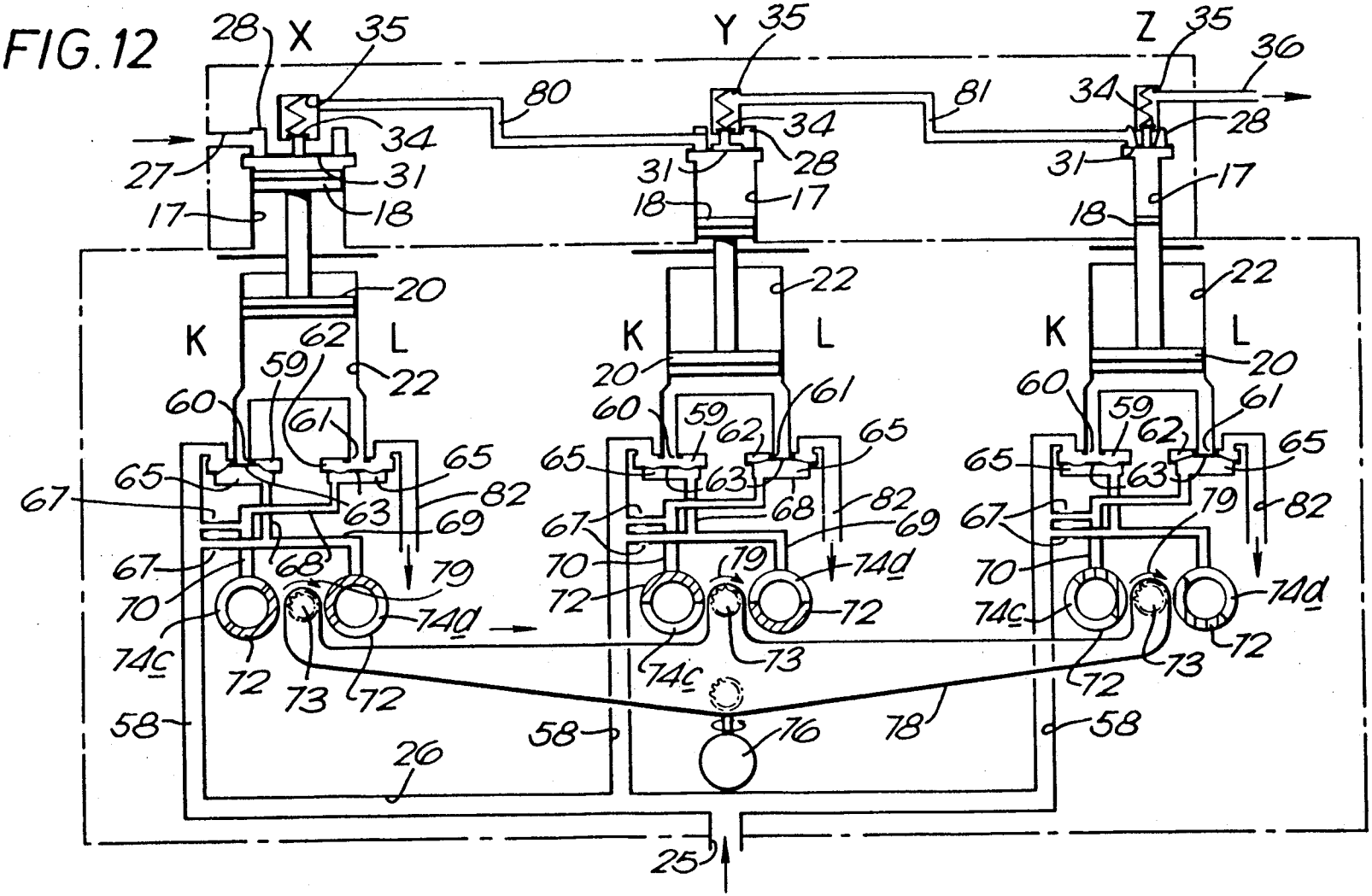
FIG. 12 is a schematic arrangement of an unillustrated embodiment.

Operation of the unillustrated embodiment comprising the combination of the embodiment of FIGS. 5 to 11 inclusive with a single-acting drive piston arrangement, is illustrated schematically in FIG. 12. It will be recalled that the upper inlet valve K and upper exhaust valve L shown in FIGS. 8 and 11 communicating with the drive cylinders 22 above each drive piston 20 are omitted. Tubular valves 72 comprise staggered ports 74*c* and 74*d* only which communicate with the control pressure chambers 65 of the single exhaust valve L and single inlet valve K respectively for each drive piston to alternately open the inlet valve K to drive the drive piston through its compression stroke and the exhaust valve L to permit the drive piston to travel through its return stroke under the influence of the pressure of the oxygen entering the respective compression chambers 17 above the compression pistons 18.

Operation will be described with reference to the first compression stage X and with particular reference to FIG. 12. Drive piston 20 is at the end of its compression stroke. Port 74*c* of valve 72 is shown in communication with passage 70 so that control pressure chamber 65 of exhaust valve L vents to ambient through the hollow bore of tubular valve 72 faster than it can be replenished through orifice 67. Passageway 69 from the control pressure chamber 65 of inlet valve K is blocked by valve 72 so that pressure in control pressure chamber 65 retains diaphragm valve 63 in contact with its valve seat 60 to prevent pressurised air in annular inlet pressure chamber 59 from entering drive cylinder 22 below drive piston 20. Pressurised oxygen entering compression cylinder 17 through connection 27 acts on the compression piston 18 to drive the compression piston 18 and therefore the attached drive piston 20 through its return stroke. The subsequent compression stroke is achieved by a reverse of the porting arrangement described and will be readily apparent to those skilled in the art.

A comparison of the schematic illustrations of FIGS. 11 and 12 show clearly the simplification achieved by the use of a single-acting drive piston (FIG. 12) as opposed to the use of the double-acting drive piston (FIG. 11).

In operation of the compressor 11 of the third illustrated embodiment (FIGS. 13 to 15 inclusive), the electric motor 76 is rotated at a predetermined speed. The consequent rotation of each cam 92 lifts alternately the associated valves 87 and 88 to sequentially vent the control pressure chambers 65 of the inlet valve K and outlet valve L of each compression stage X, Y and Z. The restricted diameter of interconnection passages 68 ensures efficient venting and also prevents simultaneous venting of the connected control pressure chamber 65.

From the prior description it will be apparent that such alternate venting of the control pressure chambers 65 operates the drive piston 20 through its compression stroke and allows the drive piston 20 to be driven through its return stroke under the influence of oxygen pressure entering compression chamber 17. In this embodiment the spring 95 in each annular exhaust chamber 62 assists during the return stroke by positively shifting the diaphragm valve 63 away from its valve seat 61 for efficient exhaustion of all of the air from the drive cylinder 22.

It will be understood that an identical operating sequence occurs sequentially for each of the three stages of compression (X), (Y) and (Z) in all embodiments of the invention. In the first illustrated embodiment this is achieved by control of the phasing of the individual solenoid valves 52, in the second illustrated embodiment sequencing is achieved by the predetermined positioning of the three valves 72 (shown diagrammatically in FIGS. 8 and 11) and the use of a single electric motor 76 driving the valves 72 via a toothed timing belt 78 to automatically retain the desired relationship during rotation. In the third illustrated embodiment of FIGS. 13 to 15 sequencing is achieved by predetermined positioning of the three cams 92 and the use of a single electric motor 76 driving all of the cams 92 via a toothed timing belt to similarly retain automatically the desired relationship during rotation.

The effects of this sequential operation of the respective drive pistons of both embodiments will now be described conveniently with reference to the double-acting drive piston arrangement of FIG. 11 and starting at the first compression stage piston 18 which is shown at the end of a compression stroke.

The return stroke of piston 18 draws oxygen through fluid inlet connection 27, inlet chamber 28 and non-return valve plate 31 to enter the cylinder 17. Movement of the piston 18 upwardly through the cylinder 17 provides a first stage compression of the oxygen or oxygen enriched air which flows out through non-return valve 34, outlet chamber 35 and internal passage 80 to the inlet chamber 28 of the second stage compression cylinder. Following second stage compression, the gas is similarly transmitted through internal passage 81 into cylinder 17 of the third compression stage, and from the outlet chamber 35 is transmitted through fluid outlet connection 36 to a storage means (not shown) for use as required in an oxygen breathing system.

It will be understood that in the single-acting drive piston arrangement illustrated in FIG. 12, the return stroke of each drive piston 20 is achieved due to the pressure of the oxygen entering the compression cylinder 17.

Thus, the pneumatically operated compressors of this invention eliminate the disadvantages of the prior hydraulically driven devices as well as the requirement to provide the complex and heavy motor and fluid control means of the prior devices to provide a safer, more compact and lighter device.

Whilst several embodiments of the invention have been described and illustrated it will be apparent that many modifications may be made without departing from the scope of the invention as defined by the appended claims. In the second illustrated embodiment, individual electric motors could be provided for each of the tubular valves 72 and sequencing could be controlled electrically. In environmentally insensitive applications the neoprene/rayon timing belt 78 could be replaced by other suitable positive drive means such as a chain.

What is claimed is:

1. A fluid compressor comprising a plurality of compression stages each having a compression piston operating in a compression cylinder and individual drive means for driving each compression stage comprising a pneumatically operated drive piston operated in a drive cylinder, wherein each said drive piston is controlled by individual control means, each control means comprising at least one inlet valve and at least one exhaust valve arranged for respectively admitting and exhausting compressed air to and form the drive cylinder at least at one side of the drive piston and drive and sequencing means associated with said control means for operating the respective individual drive means in a predetermined sequence.

2. A compressor as claimed in claim 1, wherein each inlet valve comprises a diaphragm valve co-operating with an annular valve seat opening into the drive cylinder and located centrally of an annular inlet pressure chamber and each exhaust valve comprises a diaphragm valve co-operating with an annular valve seat opening into the drive cylinder and located centrally of an annular exhaust chamber.

3. A compressor as claimed in claim 2 and including spring means located in each annular exhaust chamber and acting on the associated diaphragm valve to bias the diaphragm valve away from its seat.

4. A compressor as claimed in claim 2 and including a control pressure chamber located at the side of said diaphragm valves opposite the annular inlet pressure and exhaust chambers, the inlet pressure chambers and the control pressure chambers being connected to a supply of pressurised air and the exhaust chambers being connected via the exhaust valve to ambient.

5. A compressor as claimed in claim 4, wherein said control means includes valve means for selectively venting the control pressure chambers to operate each of the plurality of drive pistons.

6. A compressor as claimed in claim 5, wherein said valve means comprise a rotatable cam operating two valves arranged to alternately open the ends of fluid passages from the respective control pressure chambers.

7. A compressor as claimed in claim 5, wherein said valve means comprise for each drive means a tubular rotatable valve having longitudinally spaced-apart and circumferentially staggered ports arranged to communicate with fluid passages from the respective control pressure chambers in a predetermined sequence.

8. A compressor as claimed in claim 5, wherein said valve means comprises for each drive means a solenoid controlled valve means arranged to communicate with fluid passages from the respective control pressure chambers in a predetermined sequence.

9. A compressor as claimed in claim 8, wherein said valve means comprises a first valve seat opening into a vent chamber and communicating through an axial bore through a solenoid coil with one or one coupled pair of control pressure chambers, a second valve seat facing and spaced-apart from said first valve seat and opening into said vent chamber and connected to the other one or the other coupled pair of control pressure chambers, and a generally cylindrical solenoid armature located in the vent chamber and biased by a spring onto one of said valve seats whereby energisation of the coil overcomes said spring to move the armature to close the other valve seat.

10. A compressor as claimed in claim 9, wherein the plurality of solenoids are operated at a predetermined frequency to operate the drive means and are phase controlled to ensure appropriate sequential operation of the plurality of compression stages.

11. A compressor as claimed in claim 10, wherein said drive and sequencing means comprise an electric motor having a rotatable shaft attached to one of said rotating valves, each of the rotating valves having an external toothed portion all interconnected by positive drive means.

12. A compressor as claimed in claim 11, wherein said positive drive means comprises an internally toothed timing belt.

13. A compressor as claimed in claim 1, wherein said compression cylinders are of progressively reducing diameter between a largest diameter low pressure stage and a smallest diameter high pressure stage.

14. A compressor as claimed in claim 13, wherein a fluid inlet connection is provided for introducing fluid to be compressed into said low pressure compression stage, flow passages are provided for conducting fluid sequentially through said stages, and a fluid outlet connection is provided for conveying pressurised fluid from the high pressure stage.

15. A compressor as claimed in claim 1 and including three compression stages.

16. A compressor as claimed in claim 1, wherein said drive and sequencing means comprise an electric motor driving a rotatable cam means associated with each said control means, each cam means operating valve means for controlling the respective inlet and exhaust valves and being interconnected by positive drive means.

17. A compressor as claimed in claim 16, wherein said positive drive means comprise an internally toothed timing belt engaged with an externally toothed portion on each of said rotatable cam means.

18. A fluid compressor comprising a plurality of compression stages each having a compression piston operating in a compression cylinder and drive means for driving each compression stage comprising a pneumatically operated drive piston operated in a drive cylinder, each said drive piston controlled by control means comprising at least one diaphragm inlet valve co-operating with an annular valve seat opening into the drive cylinder and located centrally of an annular inlet pressure chamber, and at least one diaphragm exhaust valve co-operating with an annular valve set opening into the drive cylinder and located centrally of an annular exhaust chamber, a control pressure chamber located at the side of the diaphragm inlet and exhaust valve opposite said annular inlet pressure and exhaust chambers, the inlet pressure chambers and the control pressure chambers being connected during operation to a supply of pressurized air and the exhaust chambers being connected via the exhaust valve to ambient, said control means including a rotatable cam means adapted to operate valves for selectively venting the control pressure chambers to operate each of the drive pistons and drive and sequencing means for rotating each cam means in a predetermined sequence.

19. A compressor as claimed in claim 18, wherein said drive and sequencing means comprise an electric motor having a rotatable shaft attached to one of said rotatable cams, each of said cams having an external toothed portion all interconnected by positive drive means.

20. A compressor as claimed in claim 19, wherein said positive drive means comprises an internally toothed timing belt.

* * * * *